United States Patent [19]

Meur

[11] Patent Number: 4,903,456

[45] Date of Patent: Feb. 27, 1990

[54] DEVICE FOR CONTROLLING THE ADVANCE AND THE POSITIONING OF ENVELOPES IN AN INSERTION MACHINE

[75] Inventor: Jean-Pierre Meur, La Ville Du Bois, France

[73] Assignee: SMH Alcatel, Paris, France

[21] Appl. No.: 276,606

[22] Filed: Nov. 28, 1988

[30] Foreign Application Priority Data

Nov. 26, 1987 [FR] France ..... 87 16411

[51] Int. Cl.[4] ..... B65H 7/14; B65H 29/20

[52] U.S. Cl. ..... 53/69; 53/52; 53/266 A; 53/569; 53/250

[58] Field of Search ..... 53/69, 67, 64, 52, 77, 53/266 A, 569, 206, 251, 250, 249; 271/111, 110, 114, 266, 264

[56] References Cited

U.S. PATENT DOCUMENTS

| | | | |
|---|---|---|---|
| 3,568,401 | 3/1971 | Bonsch | 53/569 |
| 4,020,615 | 5/1977 | Irvine et al. | 53/266 R X |
| 4,337,609 | 7/1982 | Foster et al. | 53/569 |
| 4,545,178 | 10/1985 | Parthasarathi | 53/266 A X |
| 4,573,673 | 3/1986 | Haug | 271/111 |
| 4,766,715 | 8/1988 | Dimur | 53/266 A X |

FOREIGN PATENT DOCUMENTS 2048203 12/1980 United Kingdom .

*Primary Examiner*—James F. Coan

*Attorney, Agent, or Firm*—Sughrue, Mion, Zinn, Macpeak & Seas

[57] ABSTRACT

A control device for controlling the advance and the positioning of envelopes in an insertion machine includes a stepper motor (27) coupled in common both to means (20) for transferring empty envelopes towards said insertion station, and to means (40) for transferring filled envelopes to be ejected, and a circuit (70) for controlling and governing the speed of the motor, causing said motor to be driven on the basis of clock signals generated by a clock circuit (62) synchronously with mechanical commands within the machine, and governing the speed of the motor on the basis of defined numbers of motor steps as detected counting from the moment that an envelope ceases to go past an intermediate point on the transfer path, as determined by a detector (29). The invention is applicable to automatic mail processing.

21 Claims, 8 Drawing Sheets

DEVICE FOR CONTROLLING THE ADVANCE AND THE POSITIONING OF ENVELOPES IN AN INSERTION MACHINE

REFERENCE TO RELATED APPLICATIONS

This application relates to U.S. application Ser. No. 07/276,607, filed Nov. 28, 1988, entitled A DEVICE FOR EJECTING FILLED ENVELOPES, AND AN INSERTION MACHINE USING SAID DEVICE to Gerard Dimur and U.S. application Ser. No. 07/276,738, filed Nov. 28, 1988, entitled A DEVICE FOR INSERTING SHEETS INTO ENVELOPES, to Gerard Dimur and both assigned to the same assignee.

The present invention relates to machines for inserting sheets into envelopes, and within such machines it relates specifically to controlling the advance and the positioning of envelopes.

BACKGROUND OF THE INVENTION

In machines for automatically processing mail, an envelope unstacker at the outlet from an envelope magazine serves to take envelopes one-by-one from the magazine. A transfer device for transferring empty envelopes serves to transfer the separated envelopes to an insertion station for inserting sheets into said envelopes.

At the insertion station, the successive envelopes are stopped and held open. The sheets to be put into the envelopes (which sheets may be in the form of single sheets or in the form of bundles of sheets) are delivered in succession to the machine after being appropriately folded in a folding machine and optionally after being made up by a bundling machine into bundles of separate sheets either before or after folding.

The device for transferring the sheets, i.e. or the insertion device per se, transfers the successive sheets it receives and inserts them into respective envelopes at the insertion station. An ejection device for ejecting filled envelopes serves to remove each filled envelope in order to allow a new insertion operation to take place.

Control mechanisms are provided for synchronizing the operation of these various devices. In order to meet current requirements, such control mechanisms must be capable of ensuring high rates of insertion with a high level of reliability in the operation of the various devices.

Preferred implementations of devices used in an insertion machine are described in copending patent applications in the name of the Applicant, and filed on the same day as the present application. These copending applications are entitled "A device for inserting sheets into envelopes" and "A device for ejecting filled envelopes, and an insertion machine using said device". The control mechanisms control the machine to perform a set of sequences, as defined by the mechanisms, during each insertion cycle.

The object of the present invention is to control the advance and the positioning of envelopes in a manner which is rapid, precise, and reliable, which is performed during a sequence specifically for said control, which enables filled envelopes to be removed and the insertion station to be fed with empty envelopes in such a manner that each empty envelope received is accurately positioned and prepared, and which runs at variable insertion cycle operating rates using sheets of different formats and envelopes of different formats.

SUMMARY OF THE INVENTION

The present invention provides a control device for controlling the advance and the positioning of envelopes in an insertion machine, the device comprising transfer means for transferring empty envelopes along a transfer path coupled to the inlet of an insertion station, and ejection means for ejecting envelopes filled at the insertion station, said transfer means and said ejection means being operated during an ejection and feed sequence, which sequence forms a part of a set of control sequences for the machine with the sequences being defined relative to one another for each insertion cycle, the device further including:

a stepper motor coupled in common to said transfer means and to said ejection means in order to control them simultaneously;

a clock circuit generating clock signals for each cycle and in synchronism with the progress of all of said sequences;

an envelope presence detector at an intermediate point along said path; and a circuit for controlling and governing the speed of said stepper motor, said circuit being coupled to said clock circuit and to said envelope presence detector in order to receive output signals therefrom, and being equipped firstly with first detector means for detecting a first indicator of said ejection and feed sequence on a first defined clock signal in order to control motor drive and trigger a first or "advance" drive stage on the appearance of said first indicator, and secondly with first governor means for governing said advance stage by detecting motor steps, said first governor means being triggered by the output signal from said envelope presence detector indicating that the envelope has finished going past said intermediate point in order to detect a first determined number of motor steps defined relative to the distance between said intermediate point and the inlet of the insertion station and to cause the motor to stop when said first number of detected motor steps is reached.

Said first governor means advantageously causes an envelope to advance along said transfer path up to a quasi-final position for the envelope in the insertion station, and said circuit for controlling and governing the speed of said motor should then be further equipped, firstly with second detector means for detecting a second indicator of said ejection and feed sequence on a second defined clock signal in order to cause said motor to be driven and to trigger a second or "positioning" drive stage on the appearance of said second indicator, and secondly with second means for governing said positioning stage by detecting motor steps and triggered by said second indicator in order to detect a second number of motor steps representative of an advance distance between said quasi-final position and a final position.

Said stepper motor is advantageously caused to operate firstly at a variable speed during said advance stage which is performed with given motor step rate acceleration, going from a starting frequency up to a maximum frequency, after which the speed is maintained, and followed by an opposite deceleration triggered by detecting a third number of motor steps which is less than said first number relative to which said third number is defined, and secondly at a speed which is made constant during said positioning stage which is performed at a constant motor step frequency substantially equal to the starting frequency.

Said circuit for controlling and monitoring the speed of said motor may be a programmed circuit.

BRIEF DESCRIPTION OF THE DRAWINGS

An embodiment of the invention is described by way of example with reference to the accompanying drawings, in which.

MORE DETAILED DESCRIPTION

Figure 1:
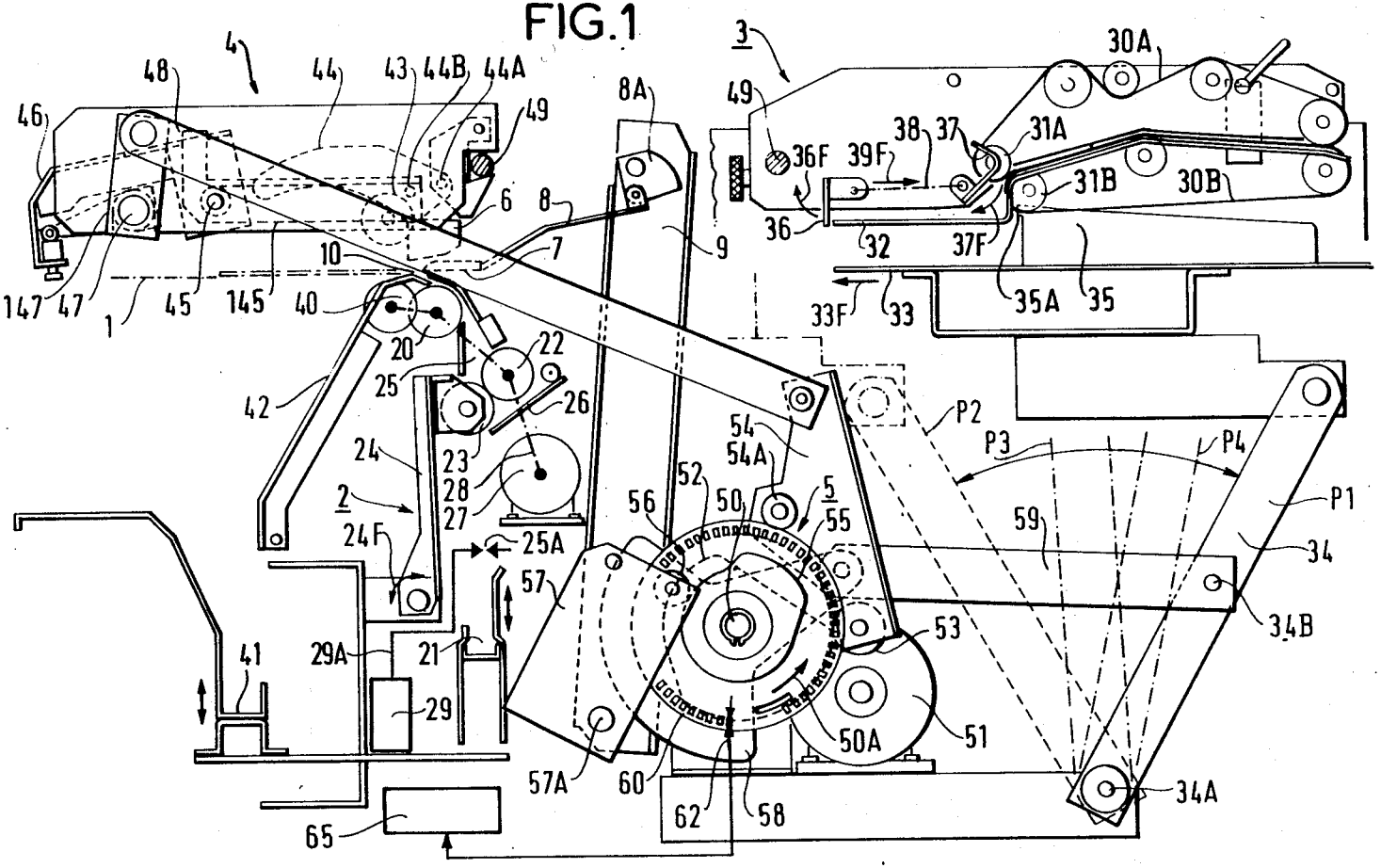
FIG. 1 is a diagrammatic overall view of an automatic insertion machine including a device for controlling the advance and the positioning of envelopes in accordance with the present invention.

FIG. 1 is a diagrammatic elevation view of an automatic insertion machine including a device for controlling the advance and positioning of envelopes in accordance with the present invention. The overall structure of this machine is in compliance with that described in the two above-specified patent applications made by the present Applicant.

The machine comprises:

a sheet insertion station 1 for inserting sheets into envelopes;

an empty envelope transfer device 2 for feeding the sheet insertion station with empty envelopes;

a sheet transfer device 3 for transferring and inserting sheets into the successive envelopes presented to the sheet insertion station, which station is also referred to as the sheet insertion device;

an ejection device 4 for ejecting filled envelopes, causing successive filled envelopes to be removed from the insertion station; and a control assembly 5 for controlling said devices 2, 3, and 4, causing them to perform defined control sequences relative to one another during each successive insertion cycle of the machine.

The sheet insertion station 1 is represented by a single dot-dashed straight line extending substantially tangentially to two wheels 20 and 40 (or two sets of wheels) which do not belong to said station per se, but which are disposed side by side, with the inlet 10 to the plane of the insertion station being defined by their peripheries and being located vertically above the gap between their axes. These wheels are described in greater detail below when describing the devices 2 and 4 to which they do, in fact, belong. The straight line segment defines the insertion plane for inserting sheets into envelopes.

The general organization of the empty envelope transfer device 2 is known, per se, and corresponds to the description of the Applicant's French patent application FR-86 07472, and entitled "A device for opening envelopes". Only a brief description of this device is incorporated in the description of the present machine.

The empty envelope transfer device 2 feeds the insertion station with envelopes and also opens the flaps of the envelopes it transfers to the insertion station. It comprises an empty envelope arrival chute 21 which extends substantially horizontally and which is fed with empty envelopes that are separate from one another. These separate empty envelopes come from an unstacker mounted at the envelope outlet from a magazine (not shown). The envelopes are conveyed along said chute 21 which couples the said unstacker to the transfer device 2. In the chute 21, the envelopes are received with their top edges, i.e. the edges from which their flaps are folded, running along the bottom of the chute.

The device 2 includes an extractor drive wheel 22 and an associated extractor backing wheel 23 disposed above the chute 21 for receiving therebetween the bottom edges or the bottom portions of the successive upsidedown envelopes present in the chute and conveyed to said drive wheels. The device also includes an outlet drive wheel which is constituted by the above-mentioned wheel 20 mounted level with the inlet to the insertion station 1. This outlet wheel 20 is mounted above the wheels 22 and 23 and serves to impart an appropriate curvature to each envelope leaving the device 2 for enabling the envelope to penetrate into the insertion station. In practice, it is associated with a backing pressure wheel which is not shown in order to avoid overcrowding the figure.

In this empty envelope transfer device 2, the extraction backing wheel 23 is mounted on a pivot arm 24 which is controlled by an electromagnet (not shown) to move in the direction of double-headed arrow 24F between a rest position where it is at a distance from the extraction wheel 22 and an extraction position in which is presses against the extraction wheel. In the rest position of the extraction backing wheel, the mid-axis of the chute is substantially tangential to said extraction backing wheel. In the extraction position of the extracting backing wheel, the mid-axis of the chute intersects the periphery of the backing wheel so that an envelope pinched between the wheels 22 and 23 is curved. A plate 26 mounted beneath the extraction wheel serves to retain the partially open envelope flap, thereby unfolding it and fully opening the envelope while the envelope is being extracted from the chute 21. The chute 21 is a channel section member having one of its flanges truncated. The back of the envelope together with the partly opened flap faces the larger of the two flanges of the chute. The chute helps impart curvature to the envelope since the envelope can bow out over the shorter flange, simultaneously opening its flap further.

The wheel 40 and the extraction and outlet wheels 22 and 20 which together constitute the means for transferring empty envelopes along the transfer path are driven by a motor 27. Dot-dashed lines 28 illustrate the coupling between the motor 27 and the wheel 40 and the wheels 22 and 20. This motor is controlled from the control assembly 5. It belongs to the device for controlling the advance and the positioning of envelopes in accordance with the invention and described in greater detail below.

In this device 2, reference 25 designates the path over which empty envelopes are transferred, which path extends from the chute 21 to the inlet 10 of the insertion station. The chute 21 constitutes the inlet to the transfer path, and envelopes arrive therein separate from one another while awaiting transfer to the insertion station. The height of the chute is adjustable as represented by the double-headed arrow associated therewith. This makes it possible to hold an empty envelope in a waiting position with the envelope standing on the bottom of the chute and also extending between the wheel 22 and the backing wheel 23 while the backing wheel is in its rest position, regardless of the format of the waiting envelope. A detector 29 situated at a point 25A on the path 25 situated between the bottom of the chute 21 and the wheel 22 and its backing wheel 23 serves to detect the presence of an envelope waiting to be transferred. This detector 29 is advantageously mounted at a distance from the point 25A and is coupled by an optical fiber 29A which terminates at said point 25A where it is associated with a light emitting cell.

The same detector 29 is also used for controlling the motor 27, as described below.

The insertion device 3 for inserting sheets into envelopes is fed with separate sheets via a sheet feed path defined by two sets of endless belts 30A and 30B. The belts are kept under tension between guide wheels and only the two terminal guide wheels at the outlet from the feed path are referenced, 31A and 31B. These two references are also used to designate the outlet from the feed path for separate sheets.

The sheet feed path may be fed by a folding machine which is itself coupled to a bundling machine (not shown) and disposed upstream or downstream therefrom. The sheets delivered in this way for insertion into the envelopes may be constituted by single folded sheets, or by a plurality of sheets which may be folded either before or after being bundled together.

This device 3 includes a fixed sheet inlet station constituted by a fixed tray 32 for receiving sheets and mounted beneath the outlet 31A, 31B and extending said outlet towards the insertion station. The fixed tray 32 is disposed slightly above the plane of the insertion station 1 and is at a distance from said station.

The device 3 also includes a serving tray 33 situated substantially in the same plane as the insertion station and serving to transfer and insert sheets into envelopes. The serving tray 33 is mounted beneath the fixed tray as a moving carriage capable of back-and-forth motion along arrow 33F. It has a control lever 34 coupled thereto for the purpose of driving it between first limit position in which it is practically retracted beneath the fixed tray 32, and a second limit position in which it is partially inside the insertion station 1 and is inserted in the envelope then present in said station. The first position corresponds substantially to that shown in solid lines, and the second position is partially indicated by dot-dashed lines.

The serving tray or carriage 33 carries a pair of pusher fingers 35 which are integral with the tray 33, which are fixed, and which are upstanding on the tray. The pusher fingers 35 also project slightly above the plane of the fixed tray 32 which has two longitudinal windows for receiving them (not shown in FIG. 1) with said windows being open at both ends of the fixed tray. Each of the pusher fingers 35 has a leading nib 35A which passes over the sheets in order to ensure that they are taken by and pushed by the fingers 35 when the carriage 33 moves toward the insertion station as illustrated by arrow 33F. The nib 35A on each pusher finger is fixed and is obtained by appropriately shaping the profile of each finger. It runs flush immediately above the level of the fixed tray 32.

The device 3 also includes sheet retaining fingers 36 mounted above the fixed tray 32 at the front thereof, and holding-down fingers 37 at the rear of the fixed tray immediately downstream from the outlet 31A, 31B from the sheet feed path. These fingers 36 and 37 are coupled by a set of levers represented by dot-dashed lines and given an overall reference 38. This set of levers 38 is itself coupled to a controlling electromagnet (not shown) acting as symbolized by arrow 39F in order to cause the retaining fingers 36 and the holding-down fingers 37 to pivot simultaneously as shown by associated arrows 36F and 37F, with the fingers moving together and in the same direction from their normal position in the absence of a control signal. As shown, in said normal position, the retaining fingers 36 constitute a transverse obstacle at the front of the fixed tray 32 while the holding-down fingers 37 are retracted above the fixed tray in order to allow a sheet to arrive freely beneath the holding-down fingers and be retained on the fixed tray 32. They remain in this position except when the sheet is being transferred from the fixed tray 32 to the carriage.

The retaining fingers 36 are adjustable at the front of the fixed tray 32 depending on the format of the sheets. The carriage 33 is also adjustable in width and in length in order to be adaptable to different sheet formats. The device 3 is not described in greater detail below. The specific arrangement of its components and its set of control levers 38 is described more completely in the Applicant's above-specified patent application entitled "A device for inserting sheets into envelopes".

The ejector device 4 for ejecting filled envelopes comprises the above-mentioned wheel 40 mounted together with the wheel 20 beneath the inlet 10 to the insertion station, with said wheel 40 being an ejection drive wheel. Like the wheel 20, the wheel 40 is constituted, in practice, by a set of wheels mounted on a common shaft. The ejector device 4 also includes a mechanism for tilting envelopes to be removed from the insertion station (not given an overall reference), an envelope reception chute 41, and a guide 42 between the wheel 40 and the chute 41.

The guide 42 is mounted sloping beneath the insertion station and serves to provide coupling between the insertion station (or more precisely its envelope inlet level with the wheel 40) and the chute 41 when the tilting mechanism acts on an envelope. This chute 41 which is also beneath the insertion station is horizontal and extends parallel to and at a small distance from the chute 21 belonging to the station 2 for transferring empty envelopes. Filled envelopes leaving the insertion station are received with their bottom edges being received in the bottom of the chute 41. Like the chute 21, the chute 41 is a channel section member having a truncated flange, and it is equipped along its length with wheels (not shown) for driving the filled envelopes it receives in the direction opposite to that in which empty envelopes are driven along the chute 21.

The level of the chute 41 is similarly adjustable relative to the plane of the insertion station 1 in order to take account of different types of filled envelopes to be removed. A double-headed arrow associated with the chute, but not referenced, illustrates this vertical adjustment, as for the chute 21.

The mechanism for tilting filled envelopes comprises a backing wheel 43 associated with the ejector wheel 40 and pivotally mounted, together with pivoting tilting fingers 44.

Individual L-shaped crank levers hinged to a common fixed axis 45 and similar to the single one 145 of these levers to be illustrated, control the components of the tilting mechanism. The hinge axis 45 passes through them substantially level with the junction between the two arms of their L shapes. The backing wheel 43 is mounted at the end of the long arm of its L-shaped lever. The tilting fingers 44 are hinged about a fixed axis 44A and are also individually coupled to the ends of the long arms of their levers by control studs 44B.

These levers such as 145 are caused to move simultaneously about the hinge axis 45 by a control lever 46. The control lever 46 is itself controlled by two other levers which are fixed to a shaft 47 and which are designated overall by reference 147. These levers 147 couple the control lever 46 to a control link 48. The link 48 is actuated by the control mechanism 5.

The lever 46 is an upsidedown generally channel-section member. One of the ends of the levers 147 is received in abutment in the end portion of the lever 46 which is at the end of the device 4, thereby coupling the lever 46 to the link 48. The short arms of the L-shaped levers such as 145 are also received in abutments in the opposite end portion of the lever 46 inside the device 4 for the purpose of controlling the L-shaped levers.

The ejection device 4 is carried by the hinge shaft 47 and on a support shaft 49 to which it is normally locked, but from which it can be unlocked by a manual operation. This ejector device 4 is not described in greater detail below. The precise arrangement of its components and their control means is described more completely in the Applicant's above-mentioned patent application entitled "A device for ejecting filled envelopes, and an insertion machine using said device".

In FIG. 1, the shaft 49 is shown twiceover; once in the facing end portions of the ejector device 4; and once the sheet insertion device 3. In practice, it is constituted by a single shaft, but the sheet insertion device which is also carried by said shaft has been offset to the right in FIG. 1 in order to clarify FIG. 1.

The machine further includes anti-return lugs 6 for preventing the return of a sheet inserted in an envelope present in the insertion station 1. Properly speaking, these anti-return lugs belong to the insertion device 3, however, they are mounted for control purposes as though they belonged to the ejection device 4. Like the tilting elements, they pivot under the control of the link 48 as transmitted by the lever 46 to the individual L-shaped levers such as 145, and they are fixed to the ends of the long arms their L-shaped levers.

These anti-return lugs 6 are above the insertion station 1. They face the envelope inlet 10 to said insertion station and they are at the end of the insertion device 3.

In addition to the devices 2, 3, and 4, and the anti-return lugs 6 mounted in the device 4, the machine illustrated in FIG. 1 includes fingers 7 for opening the body of an envelope present in the insertion station.

Like the anti-return lugs 6, these opening fingers 7 belong to the insertion device 3. They are mounted in front of the retaiing fingers 36 and are disposed immediately in front of the envelope inlet to the insertion station. They are formed at the ends of individual supports 8 whose opposite ends are coupled by hooking tabs 8A to a common actuator lever 9.

The control assembly 5 essentially comprises a drive shaft 50 having cams mounted thereon and driven in the direction of arrows 50A by a control motor 51. This shaft 50 has a first cam 52 for controlling the ejection device 4 and referred to as the ejection cam. An ejection wheel 53 carried by a hinged lever 54 bears against the ejection cam 52. The lever 54 is hinged about a fixed axis 54A and is also coupled to the link 48 for controlling the ejection device under its control.

The same shaft 50 also carries a second cam 55 for controlling the opening fingers 7, with said cam being referred to as the envelope body opening cam. An opening control wheel 56 bears against the opening cam 55 and is carried by a support lever 57. This lever 57 is coupled to the lever 9 at a fixed hinge axis 57A and it controls the lever 9 to actuate the opening fingers 7.

The shaft 50 also controls a connecting link and crank system whose crank 58 constitutes a flywheel fixed to the shaft and drives a connecting link 59. This link 59 is itself hinged to the lever 34 which controls the carriage 33 in order to move it back and forth. The lever 34 has one of its ends coupled to the carriage and has its other end coupled to a fixed hinge axis 34A. It is hinged substantially in the middle to the link 59 by a hinge 34B.

With respect to this carriage drive, references P1 and P2 designate the substantially extreme positions taken up by the lever 34 for controlling the carriage 33, while references P3 and P4 mark two special intermediate positions.

The same shaft 50 also carries a disk 60 for encoding the angular position of the shaft.

Figure 2:
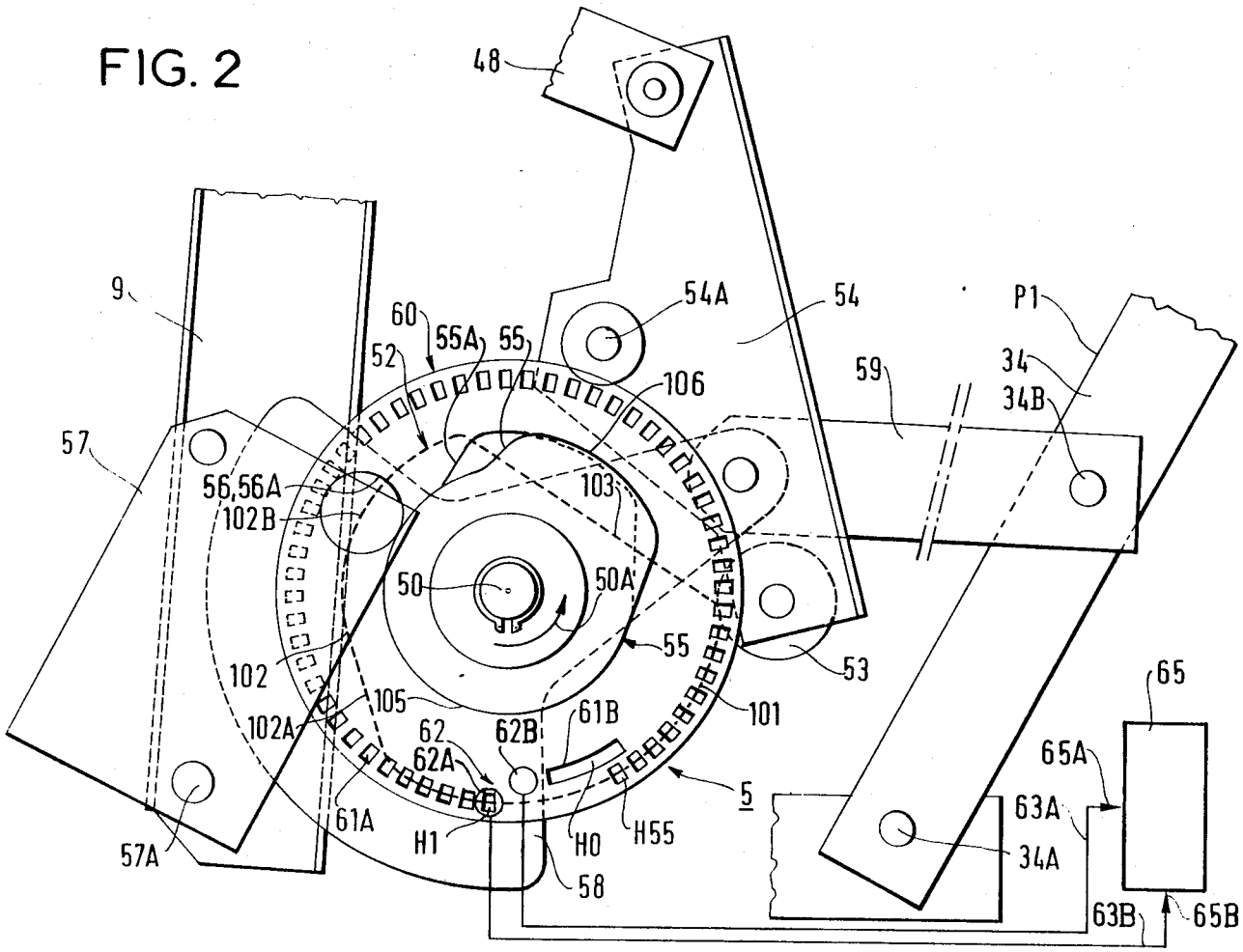
FIG. 2 is an enlarged view of the control assembly for causing said machine to perform sequences which are defined relative to one another.

A photoelectric cell referenced 62 delivers this angular position. The disk 60 has a plurality of regularly spaced-apart identical openings which are detected by the sensor 62 in order to deliver successive angular positions of the shaft 50. The disk 60 also has a single, larger opening which is also detected by the sensor and serves to define a reference position. These openings are not referenced in FIG. 1, and they are described in greater detail with reference to FIG. 2. In FIGS. 1 and 2, the sensor 62 is shown as being coupled to a counter 65.

The machine shown in FIG. 1 is controlled by the control assembly 5 which is shown in greater detail in FIG. 2, and it is controlled to perform sequences which are defined relative to each other during each insertion cycle.

In FIG. 2, the items already mentioned while describing FIG. 1 are designated by the same references. They are used again below.

The periphery of the ejection cam 52 mounted on the driving cam shaft 50 and against which the control wheel 53 is pressed is essentially constituted by three successive distinct portions referenced 101, 102, and 103, with each portion occupying a sector of about 120°. The portion 101 is circular and is the radially outermost portion of the periphery. The portion 103 constitutes a flat on the ejection cam and is the portion which projects least, radially. The portion 102 is intermediate, and is itself constituted by two portions of similar length, having a substantially linear portion 102A adjacent to the portion 101, and a substantially circular portion 102B adjacent to the portion 103. The portion 101 is referred to as the "rest" portion, the portion 103 is referred to as the "ejection" portion, and the portion 102 is a transition portion between the portions 101 and 103, with said terms being derived from the control effects which said portions transmit to the ejection device via the wheel 53, the lever 54, and the link 48.

The flywheel 48 rotates with the shaft 50 which drives it. The system comprising the link 59 and the lever 34 transforms this rotary motion of the flywheel 58 into alternating motion which is transmitted to the carriage of the sheet insertion device 3, imparting a variable speed to the carriage along its "go" stroke towards the insertion station and also along its "return" stroke.

The periphery of the cam 55 for opening the envelope bodies and mounted on the drive shaft 50 has the control wheel 56 pressed thereagainst, and essentially comprises two portions 105 and 106 both of which are semicircular, but having different radiuses. The portion 105 is considerably longer than the other portion 106, however its radius is smaller than that of the portion 106. These portions 105 and 106 are separated by substantially linear transitions for rapidly changing the imparted control position. The portion 105 is the "rest" portion and the portion 106 is the envelope "body-open" portion, with said terms being related to the effects they transmit to the opening fingers via the wheel 56 and the control lever 9.

In order to take account of the various different possible formats of sheet to be put into corresponding envelopes, which may also be of various different formats, the control lever 9 is also capable of being pivoted by an auxiliary cam 55A which is analogous to the cam 55 and which is also mounted on the shaft 50, but which imparts a slightly advanced control action to the lever 9. The associated cam follower wheel 56A of said cam 55A is selectively actuated to occupy a position where it presses against the cam 55A or a position where it is retracted away from the cam 55A under the control of an electromagnet proivded for this purpose and not shown. When the wheel 56A is in its retracted position, only the cam 55 acts on the lever 9, whereas when the wheel 56A is pressed against its cam 55A, then both cams 55 and 55A act on the lever 9. The beginning of this combined action is determined by the cam 55A whereas the end of the combined action is determined by the cam 55. Advantageously, the two cams 55 and 55A are mounted on either side of the coding disk 60.

The coding disk 60 which is also mounted on the drive shaft 50 and which is caused to rotate together with the cams 52, 55, and 55A, enables the relative positions of the cams and the flywheel 58 to be accurately determined for the progress of the mechanical controls they provide. Also, with respect to the various control sequences defined relative to one another for each insertion cycle, the disk makes it possible to ensure that the sequences under mechanical control take place at the appropriate times relative to sequences under electronic control and based on sensor 62. This is done by generating clock signals which are synchronized with the mechanical controls provided for each rotation of the drive shaft 50.

To this end, the disk 60 has a series of small openings such as 61A formed at a regular pitch around nearly all of its periphery except for a small gap having no such openings. The disk 60 is shown as having 55 small openings 61A and the small gap corresponds to 5 missing openings. The sensor 62 comprises two sensors, with two emitting cells associated with two respective receiving cells. One of the sensors 62A in this pair of sensors is mounted in association with the small openings 61A. References H1 and H55 at the periphery of the disk and facing the end most openings constitute the end most clock signals generated when all of the illustrated 55 small openings 61A are detected as they pass the sensor 62A during one complete rotation of the disk 60 and the shaft 50. FIG. 2 also shows said sensor 62A being coupled to a count input 65A of a counter 65 in order to form an incremental clock circuit.

The disk 60 also has a long opening 61B which is formed slightly further in from the edge of the disk than the small openings 61A and which extends, at least in part, level with the gap having no openings 61A. The second sensor 62B of the pair of sensors 62 is mounted to detect said longer opening 61B.

Each time the long opening 61B passes in front of the second sensor 62B of the pair of sensors 62, the second sensor 62B generates a clock signal refernece HO representative of a reference or rest angular position of the machine. This second sensor is shown as being coupled to a reset-to-zero input 65B of the counter 65. This clock signal HO corresponds to a small number of signals such as H1, H2, H3, . . . , H55, and has a duration of between 2 and 5 of said signals, in order to provide a range which is large enough to enable the shaft 50 to come to rest if the machine is to stop.

As shown in FIG. 2, it is advantageous for the longer opening 61B to extend level with the end most small opening 61A giving rise to the signal H55 and to continue therefrom over a portion of the gap having no small openings 61A. In this case, said portion corresponds to 3 of the 5 missing openings. The sensor 62B is offset angularly relative to the sensor 62A by a corresponding amount, i.e. by two steps of the clock H1 to H55. This offset compensates for the longer opening 61B not being centered over the entire gap having no openings 61A. It also serves to facilitate mounting the two sensors by using optical fibers 63A and 63B which are indivdiually connected to two detector cells which are remote from the disk 60 and which are individually coupled via the openings 61A or the openings 61B, as the case may be to two emitting cells in order to detect the passages of said openings, while avoiding inerference between either of the emitting cells and the fiber associated with the other emitting cell.

By virtue of this disposition, when the sensor 62A provides a clock signal H55, the longer opening 61B is still not level with the sensor 62B. However, as the shaft continues to rotate, after the clock signal H55 is over, the longer opening 61B reaches the sensor 62B and the signal HO is generated. Similarly, by the time the sensor 62A gives rise to a new clock signal H1, the long opening 61B has left its sensor 62B so that the clock signal H1 and the following signals H2, . . . , H55 give rise to various different commands being performed.

The essential operating sequences of the machine are described below with reference to the clock signals which are mentioned below for an insertion cycle performed by one complete turn of the driving cam shaft 50.

Sequence 1—carriage advance sequence

This sequence corresponds to clock signals H0 to H28, with the sheet beginning to be inserted into the envelope at H14 and with the sheet being fully inserted in the envelope at H28, said insertion being provided by the mechanical commands transmitted to the lever 34, by the rod and crank system 59, 58. The following two sub-sequences also take place during said sequence 1.

A first sub-sequence in which the sheet is transferred from the fixed inlet tray 32 to the carriage under electronic control based on the sensor 62 and taking place from H0 to H14 with the retaining fingers 36 being retracted and the holding-down fingers 37 being lowered.

A second envelope body opening sub-sequence controlled mechanically by the cam 55 or by the cams 55 and 55A, takes place from H8 to H21 for small format envelopes and from H5 to H21 for large format envelopes, with the opening fingers advancing from H8 to H12 for small envelopes and from H5 to H9 for large envelopes and with the opening fingers being retracted from the envelopes at H21.

Sequence 2—sheet in envelope retaining sequence

This sequence is controlled mechanically by the cam 52 from signals H24 to H54. During this sequence the anti-return lugs 6 are in the low position.

Sequence 3—carriage return sequence

This sequence runs from signal H28 to signal H0, with the carriage being fully withdrawn from the envelope as from H42. It is mechanically controlled by the rod and crank 59–58.

Sequence 4—envelope ejection and feed sequence

An envelope is ejected from the envelope insertion station and another one is fed thereto. This sequence begins on signal H41 and extends substantially up to signal H8 for large envelopes or up to signal H11 for small envelopes.

It comprises two sub-sequences:

A first, tilting sub-sequence which rapidly lowers the envelope tilting components from H41 to H44, after which these components are held down from H44 to H53, and they are then raised from H53 to H0. This first sub-sequence is controlled mechanically by the cam 52.

A second envelope advance and positioning sub-sequence in which the drive wheels 20 and 40 are switching on, both for bringing in an empty envelope and for ejecting a filled envelope. This sub-sequence is under electronic control and it is triggered by the sensor 62 at signal H45 for small envelopes and at signal H47 for large envelopes.

Insertion cycles follow one another with their essential sequences interfitting or overlapping as the case may be. When the machine is started, insertion cycles are preceded by an initialization cycle in which an empty envelope is brought to the insertion station and a sheet is brought to the fixed inlet tray, and during which account is taken of parameters relating to the formats then concerned. When an overall stop command is given, the machine comes to rest in its reference position as indicated by the appearance of the signal H0.

Figure 3:
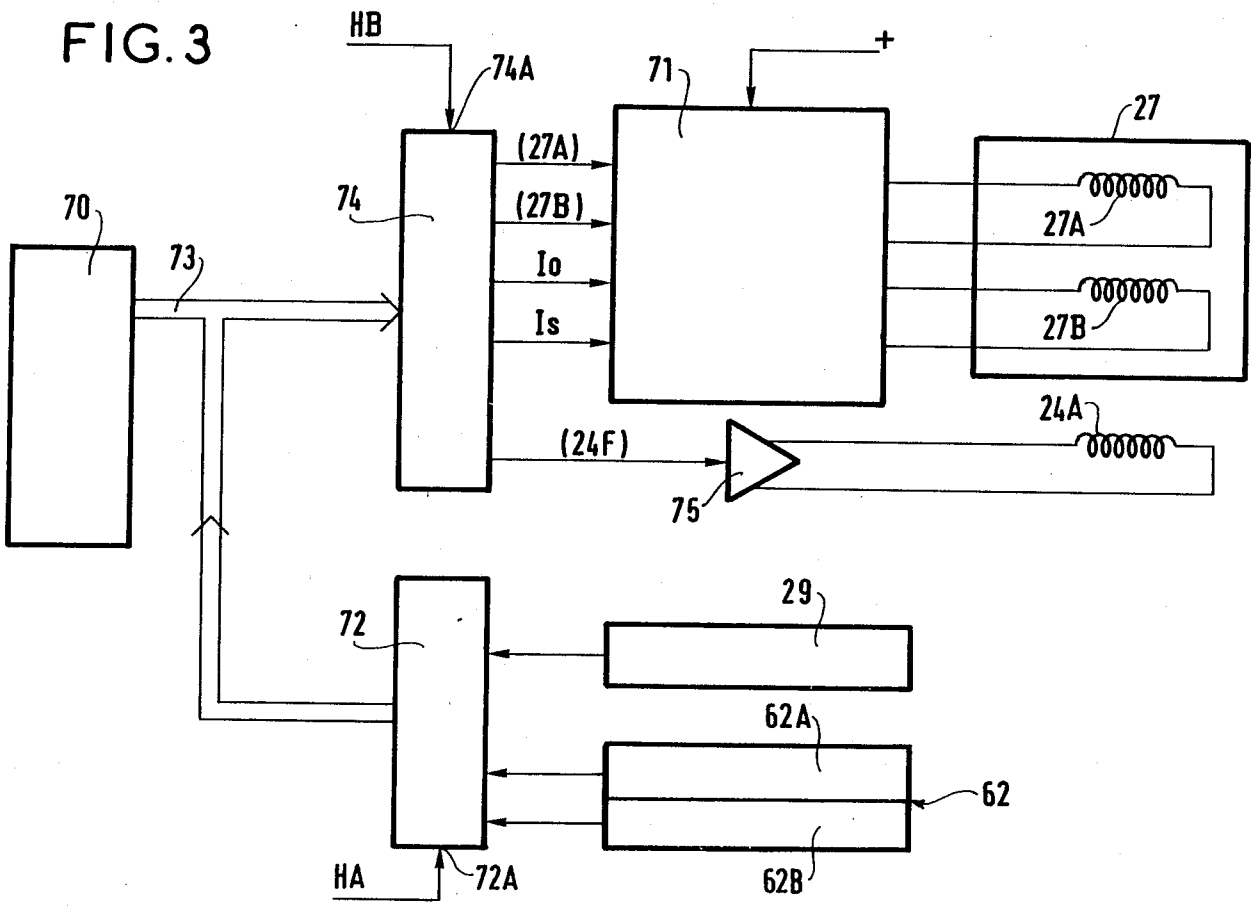
FIG. 3 is a block diagram of the device for controlling the advance and the positioning of envelopes during one of the sequences, said sequence being referred to as the ejection sequences and as the insertion station feed sequence.

FIG. 3 is a diagram of the device for controlling the advance and the positioning of envelopes in accordance with the invention, which device performs the envelope advance and positioning sub-sequence within above-specified sequence 4, during each insertion cycle.

This device comprises the motor 27 which is a stepper motor controlled at variable speed by a microprocessor 70 via an electronic power control circuit 71 which feeds the windings of the motor with pulses of current. An inlet register 72 is connected firstly to the sensor 62 which is coupled to the control assembly 5 of the machine as shown in FIGS. 1 and 2 and which generates the clock signals H synchronously with the operation of the sequences, and secondly to the detector 29 of the transfer device 2 of the machine shown in FIG. 1. The register constitutes an input interface circuit for transmitting data to the bus 73 of the microprocessor. This input register 72 has a decoding input 72A to which an activating clock signal HA is applied once every millisecond. An output register 74 constitutes an output interface circuit for transmitting and maintaining commands received from the bus 73 and applied, in particular to the power control circuit 71. It has a decoding input 74A on which an activation clock signal HB is applied each time the motor 27 is to move one step, and also every 15 ms.

In the embodiment described, the stepper motor is a motor having bipolar stators, with the two windings per stator being represented by 27A and 27B. It has defined kinetic characteristics, such as its number of steps per rotation about is axis (200), its starting frequency (150 Hz), and its maximum step frequency after regular acceleration (1200 Hz).

The output register 74 has four outputs connected to the power control circuit 71 and used for controlling the stepper motor, with said outputs being used to deliver two logic level signals referenced 27A and 27B for controlling each of the two windings, together with magnitudes Io and Is representative of the currents to be fed thereto. The output register also has an additional output via which a signal referenced 27F is delivered for causing the backing wheel 23 of the device 2 in the machine shown in FIG. 1 to be put into its envelope-extraction position. The signal 24F is amplified by an amplifier 74 and is applied to an electromagnet represented by a coil 24A for actuating the support arm of said backing wheel.

The power control circuit 71 is constituted by a group of transistors associated with each winding. As such it is known and is therefore not described in detail. It serves to control the rise time of the current in the motor windings without making use of additional resistances in order to limit the amount of heat energy dissipated; the average power consumption, and the current leaving the logic control circuit and passing through the windings.

The microprocessor includes the above-mentioned counter 65 which receives the signals H delivered by the sensor. Within the microprocessor, the counter is constituted by a table of values which are moved through, starting from a value 0 on receiving the signal issued by sensor 62B, moving at a rate clocked by the signals coming from sensor 62A.

The microprocessor controls the progress of the envelope advance and positioning sub-sequence and governs the stepper motor speed. During said sub-sequence it ensures that an empty envelope is advanced and put into position in the insertion station and also removes a filled envelope in a sequence of three successive stages using different stepper motor speeds:

stage 1 in which the empty envelope is advanced nearly to its final position in the insertion station with the stepper motor being driven at a speed which varies from its starting step frequency up to its maximum frequency, and is subsequently stopped. Prior to this stage 1, the backing wheel 23 of the device 2 (FIG. 2) has moved into its extraction position, and it is returned to its rest position during said stage 1;

stage 2 in which the empty envelope is put into its final position in the insertion station and during which the stepper motor is again put into motion, but this time at a constant low speed; and stage 3 in which a filled envelope is advanced and during which the filled envelope is extracted from the insertion station prior to a new empty envelope arriving therein.

In continuous operation, stages 3 and 1 overlap so as to enable a very high insertion cycle rate to be achieved by the machine. If there is not empty envelope waiting to be transferred, then stage 3 is performed on its own. The progress of this sub-sequence is given in full detail below with reference to the flow chart of the program which controls it.

These stages are triggered by specific "flags" or indicators, one for overlapping stages 1 and 3 and another for stage 2, depending on envelope type. These specific indicators are obtained within the microprocessor 70 on the basis of a table of stored values which is scanned through by moving through the table at the rate of pulses H0 to H55 during each insertion cycle, and also on the basis of a comparator which receives the successive values scanned in the table and also values which have been previously selected and recorded.

Figure 4:
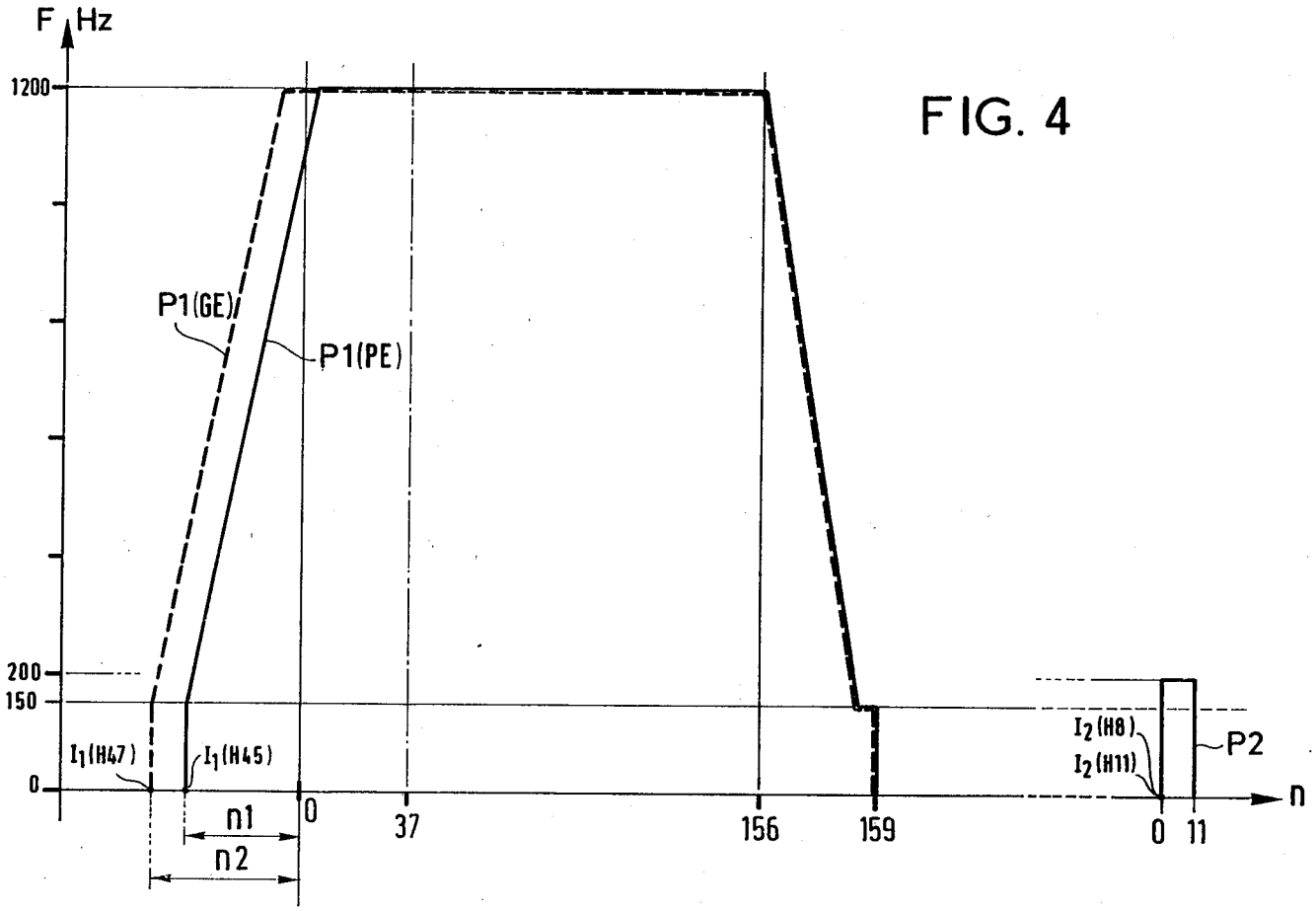
FIG. 4 is a diagram showing how the FIG. 3 device controls the speed of the motor for advancing and positioning the envelopes.

FIG. 4 shows how the speed of the stepper motor is governed by the microprocessor firstly for performing stages 1 and 3, and secondly for performing stage 2.

In FIG. 4, curves P1(PE) and P1(GE) show the change in frequency F of motor steps during stages 1 and 3 respectively for advancing small envelopes and for advancing larger envelopes along the transfer path. This variation in frequency F is given from a certain position of the envelope along its path, which position is detected as a function of the number n of motor steps. The change in the number of steps n is then detected from said position which is represented by n=0.

These two curves P1(PE) and P1(GE) show that once the specific indicator corresponding to small envelopes or large envelopes appears at I1(H45) or at I1(H47), i.e. at the starting points of the curves and at positions along the step axis which are unspecified in terms of number n of motor steps, the frequency F of motor steps is caused to increase regularly with an acceleration of 20 Hz/ms, i.e. 20 steps per second per millisecond, from an initial value of 150 Hz up to a maximum value of 1200 Hz at which it is maintained.

The frequency F is maintained at its maximum value counting from the moment that the detector 29 informs the microprocessor that the envelope has finished going past point 25A in the transfer path, which instant is designated by n=0, directly by the envelope itself going beyond said point 25A. Subsequent envelope advance is evaluated in terms of motor steps. By detecting envelope advance beyond the point 25A in this way, it is possible to avoid adapting the performance of stages 1 and 3 as a function of the dimensions of the envelopes. Envelope advance is obtained directly in the microprocessor from the commands it generates for the power circuit. Thus, the frequency F is maintained at its maximum value until a first number of motor steps beyond n =0 is detected, e.g. n=156. Thereafter the frequency is reduced regularly at a decelleration of 20 Hz/ms down to the starting value of 150 Hz at which it is maintained until a second number of motor steps is detected, in this case n=195, at which point the motor is stopped. This second number n =195 is representative of the number of motor steps required to move an envelope after leaving the point 25A so as to make it arrive in its quasi-final position in the insertion station. By choosing the first number of steps to be detected at which deceleration begins to have a value n=156 which is slightly smaller than the value which would ensure that the envelope reaches its desired quasi-final position at the end of deceleration, ensures that the envelope arrives slowly in said quasi-final position, and therefore that it stops instantaneously.

In FIG. 4, curve P2 represents the execution of stage 2, regardless of envelope size. Stage 2 is triggered by the appearance either of a special indicator for small envelopes, or else of a different special indicator for large envelopes, with these indicators written I2(H11) and I2(H8) defining the starting point for curve B2, and both of them being expressed as n=0 within the microprocessor. Once stage 2 has been triggered, the stepper motor is caused to advance throughout stage 2 at a step frequency F which is kept constant, at a low frequency of 200 Hz, close to the starting frequency. This continues until the number of motor steps is detected as reaching the number required for causing the envelope to advance from its quasi-final position to its final position, i.e. n=11.

In the figure, n1 and n2 show the number of motor steps that are required counting from the starting points of the curves P1(PE) and P1(GE) to the origin point n=0 for the envelope concerned to advance from its position awaiting transfer to the end of its passage past the point 25A in the transfer path. These numbers n1 and n2 are known but are not necessarily detected other than when executing phase 1 during a machine initialization cycle when the machine is switched on.

With reference to curves P1(PE) and P1(GE), a third number of steps as detected by the microprocessor, n=37, is also marked. This third number of steps is not used for governing the speed of the motor, but is used to trigger a command delivered by microprocessor advance stages 1 and 3. This third number corresponds to it being certain that any envelope (be it small or large) has indeed arrived level with the wheel 20 and its backing wheel. At this point, when it is certain that the envelope can be engaged between the wheel 20 and its backing wheel, the microprocessor resets the electromagnet actuating the support arm of the extraction backing wheel 23 to zero, thereby putting the extraction backing wheel into its rest or retracted position.

The microprocessor obtains the various different numbers of motor steps to be detected for issuing commands during the progress of stages 1 and 3 by scanning through a table of values, in a manner similar to obtaining the above-mentioned indicators I1 and I2. The table is scanned at the step rate of the motor on the basis of commands generated by the microprocessor. The commands to be issued are defined by performing comparisons between each of the above-mentioned selected values and the successive values obtained from each of the corresponding tables.

The envelope advance and positioning sub-sequence progresses under the control of a control program provided for this purpose and contained in the microprocessor.

Figure 5:
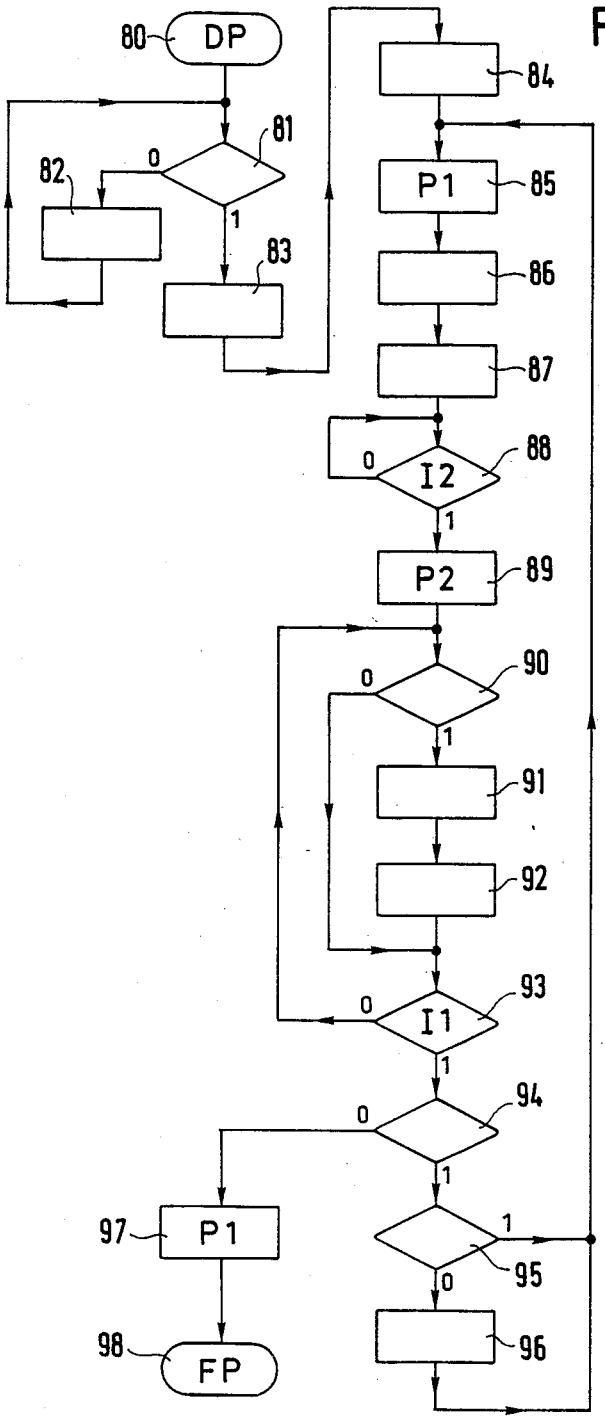
FIG. 5 is a flow chart of the control sequence contained in the FIG. 3 device.

FIG. 5 is a flow chart of said control program.

In FIG. 5, successive command actions of the components of the machine as defined below are represented by rectangles designated by references, whereas losanges, also referenced, are used to designate decision operations on which the actions depend, with said decisions also being defined below.

At a losange outlet, the digit 1 means "yes" and the digit 0 means "no".

The program is cused to run by a beginning-of-program instruction DP, referenced 80, which is triggered when the machine is switched on. Thereafter, the programs runs with each action being triggered by the preceding action or by a preceding decision operation. These actions and decision operations are as follows:

detect the presence of an envelope waiting to be transferred at operation 81, with such detection being given by the state of detector 29;

if an envelope is not detected as being present, then order envelope feed at action 82, with envelopes being fed from an envelope unstacker which feeds the machine, return to operation 81;

if an envelope is detected as being present, put the backing wheel 23 into its extraction position at action 83 by controlling the electromagnet 24A for actuating its support arm;

wait for said extraction position to be taken up, by means of a time delay action 84 giving rise to a time delay of 0.5 s;

at action 85 execute stage 1 of the envelope advance and positioning sub-sequence by controlling the stepper motor to follow the appropriate curve P1 in FIG. 4 (reference P1);

put the extraction backing wheel 23 into its rest position at action 86 by resetting electromagnet 24A which actuates its support arm to zero when the stepper motor step count reaches the number n=37 as detected during the performance of action 85;

during action 87, order the unstacking device coupled to the machine to feed an envelope;

detect indicator I2 selected for the type of envelope in use during operation 88 (noted I2) with outlet 0 being looped back to its inlet in order to wait for said indication I2 to be detected prior to moving onto the following actions;

if indicator I2 is detected, perform phase 2 of the envelope advance and position control sub-sequence at action 89 by controlling the stepper motor to perform curve P2 of FIG. 4 (marked P2);

detect the presence of an envelope waiting to be transferred at operation 90;

if an envelope is detected as being present during operation 90, then put the extraction backing wheel 23 into its extraction position during action 91 by controlling its electromagnet 24A;

start a 100 ms time delay in action 92 for ensuring that the backing wheel 23 reaches its extraction position with the envelope ready to be transferred;

if an envelope is not detected as being present during operation 90, or if action 92 has been performed, detect indicator I1 selected for the type of envelope in use in an operation 93 (marked I1) whose 0 output is looped back to the input of operation 90 to wait for the detection of said indicator I1 while repeating operation 90 for detecting the presence of an envelope and triggering actions 91 and 92, where appropriate;

if indicator I1 is detected, detect the presence of an envelope waiting to be transferred in an operation 94;

if an envelope is detected as being present during operation 94, test that the 100 ms time delay triggered by action 92 has expired in an operation 95 whose 1 output is looped back to the input of action 85;

if the 100 ms time delay triggered by action 92 has not elapsed, slow down the operating rate of the machine in an action 96 by slowing down the speed of rotation of the drive shaft 50 in assembly 5 of FIG. 2, and continue running the program at action 85 using the same loop as action 96 on action 85;

if an envelope is not detected as being present during operation 94, execute stage 1 of the envelope advance and positioning control sub-sequence in an action 97 by controlling the stepper motor in accordance with the corresponding curve P1 in FIG. 4 (marked P1) in order to advance the filled envelope now being evacuated; and go to the end of the control program at an instruction 98 marked FP.

If any fault is detected in the supply and advance of filled or empty envelopes while this program is running, then the program is interrupted and it switches directly to the end of program instruction FP by means of an action which is not shown in the flow chart.

In the flow chart, the loop from operation 95 directly or through action 96 back to action 85 means that actions and operations 85 to 95 or 96 are repeated and this corresponds to continuous operating conditions.

However, the execution of actions and operations from operation 81 corresponds to a sub-sequence belonging to a first or initialization cycle for the machine. During this initialization sub-sequence, action 85 serves only to advance an empty envelope with the number of steps, n1 or n2, from the beginning of envelope advance to the end of its passage past the point 25A in the transfer path being simultaneously detected. By detecting the number of steps n1 or n2, the microprocessor determined the type of envelope in use and then selects the appropriate pair of indicators I1 and I2 for use under steady state conditions. It also controls the selection of cam 55 on its own or cams 55 and 55A together for actuating the envelope body opening fingers for opening envelopes of the appropriate type, by causing cam follower wheel 56 to operate on its own or by causing both cam follower wheels 56 and 56A to operate together. In addition, detecting this number makes it possible to limit the maximum insertion rate, in particular when the envelopes are large envelopes.

With respect to this flow chart and to FIGS. 2 and 4 relating to controlling the machine and the stepper motor, it is specified that by stopping an envelope in its quasi-final position in the insertion station and then moving it slowly into the final position, it is possible to open the body of said envelope under mechanical control from the cam 55 or from the cams 55 and 55A.

FIGS. 6 to 9 are fragmentary views of the machine shown in FIG. 1 and they illustrate the various different stages in controlling the advance and the positioning of empty envelopes in the insertion station. In order to avoid overcrowding the figures., the advance of the envelopes once they have been filled (which takes place simultaneously with the advance of the empty envelopes) is not shown.

The items shown in these figures. carry the same references as in FIG. 1 and they are therefore not described again. It is merely specified that the inlet 10 to the insertion station defines an edge which projects slightly above the plane of the insertion station 1. This edge is formed by the end of a guide sheet 11 at the outlet from the empty envelope transfer path 25 which ends at a fold in a supporting sheet 12. The edge 10 is substantially centered vertically over the middle of the distance between the axes of wheels 20 and 40.

Figure 6:
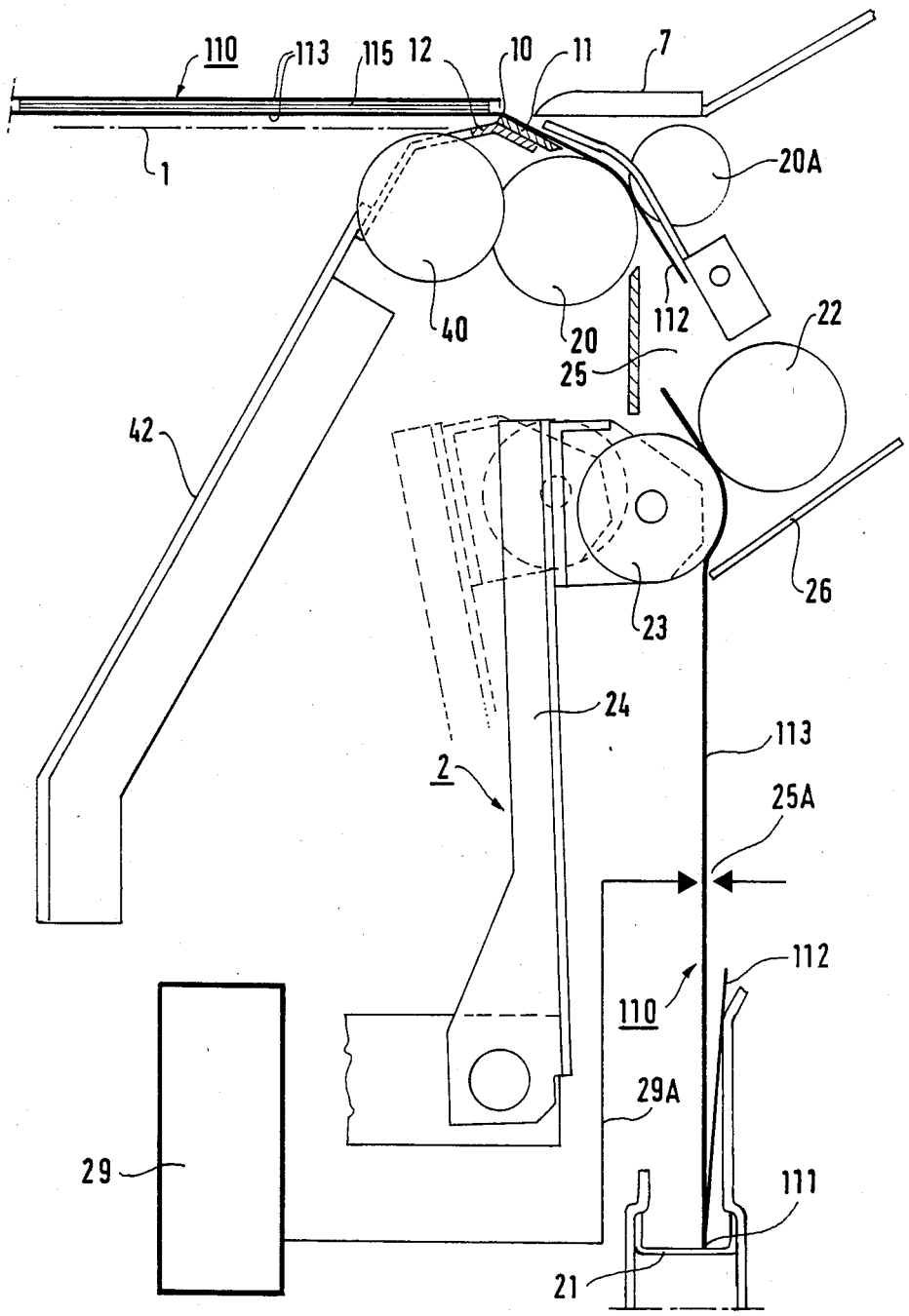
FIGS. 6 to 9 are fragmentary views of the machine on a larger scale showing the commands applied to the various elements of the machine while envelopes are being advanced and positioned in accordance with the invention.

FIG. 6 shows the position of the items concerned during decision operation 94 in the flow chart of FIG. 5, in which an empty envelope 110 is detected as waiting for transfer. Under these conditions, the same empty envelope has already been detected during operation 90 which has caused the backing wheel to take up its extraction position in action 91 of the flow chart. The edge of the empty envelope having the fold line 111 between its flap 112 and the body 113 of the envelope rests in the bottom of the chute 21 and the opposite end portion of the envelope is engaged between the wheel 22 and its backing wheel 23. The envelope is ready to be transferred towards the insertion station 1 in which the previous envelope 110 to be transferred has received a sheet 115 and is now ready to be evacuated. None of the components of the machine now prevents the filled envelope from being evacuated and this will take place while action 85 is being executed simultaneously with the empty envelope advancing in accordance with stage 1 of the control sub-sequence.

Figure 7:
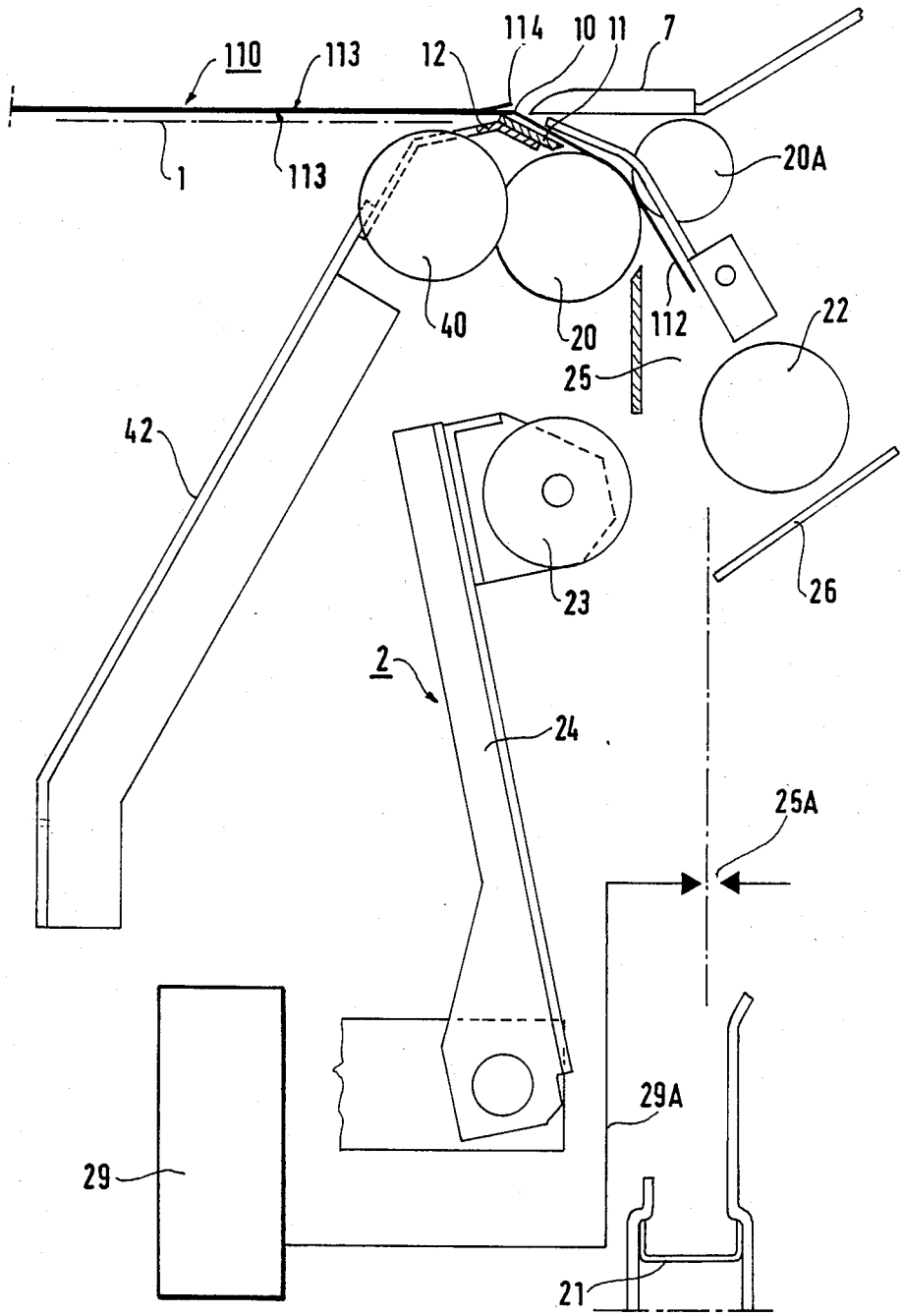

FIG. 7 shows the positions of the same items after action 85 of the flow chart of FIG. 5 has been executed. The empty envelope 110 has stopped in its quasi-final position in the insertion station 1 at a distance of 11 motor steps from its final position (using the numbers of the above example). In this quasi-final position, the end portion of the front face of the envelope body 113 (which is attached to the now-open flap 112 which is itself held open thus making the fold line which connects it to the body of the envelope invisible in the figure), rests on the edge 10 at the inlet to the insertion station 1. Under these conditions, this end portion leaves the ends marked 114 of the back wall of the envelope body slightly open, with said ends being set back slightly from the edge 10 and facing the opening fingers 7 which are still in the retracted position. This opening of the ends 114 leaves a gap via which the retaining fingers can enter into the body of the envelope in order to facilitate entry of the opening fingers, with the advance into the body of the envelope of the opening fingers beginning slightly before action 89 and with their being held inside the body of the envelope continuing with said action.

FIG. 7 also shows that during performance of action 85, the extraction backing wheel 83 is returned to its retracted or rest position in order to allow a new empty envelope to arrive in the chute 21 and come to rest therein between the extraction backing wheel in its retracted or rest position and the extraction drive wheel, waiting to be transferred to the insertion station.

Figure 8:
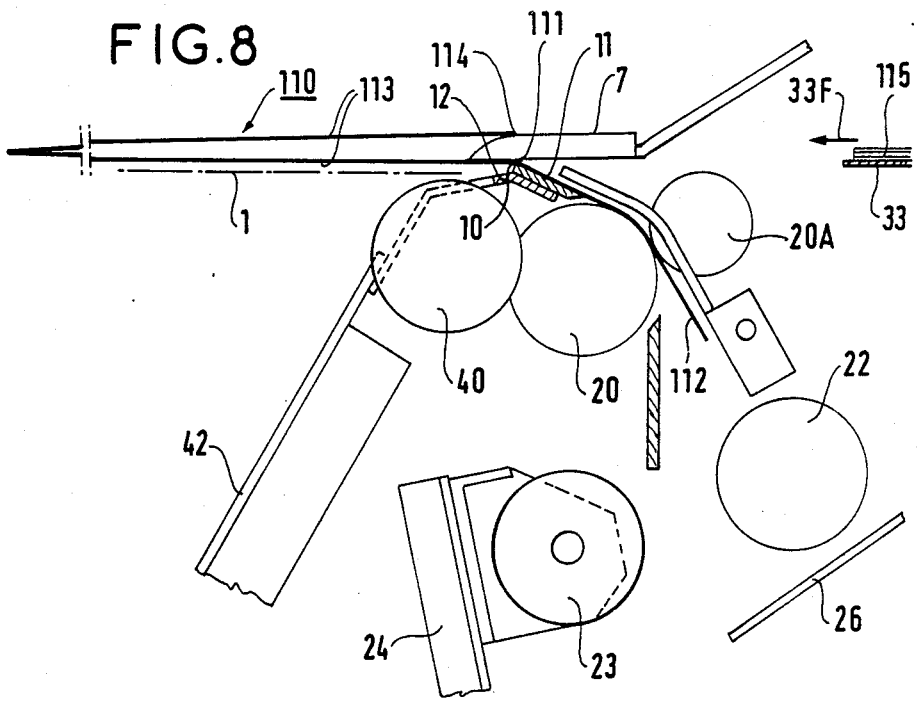

FIG. 8 shows the position taken up by the items after action 89 of the FIG. 5 flow chart has been performed. The empty envelope 110 is stopped in its final position in the insertion station. The fold line 111 between the flap 112 and the body of the envelope 113 rests against the inlet edge 10 of the insertion station and the fold along this line is now in the opposite direction to that which it normally takes up with the flap folded against the body of the envelope by virtue of the edge 10 holding the fold line and the flap 112 being held between the wheel 20 and its associated backing wheel 20A.

Figure 9:
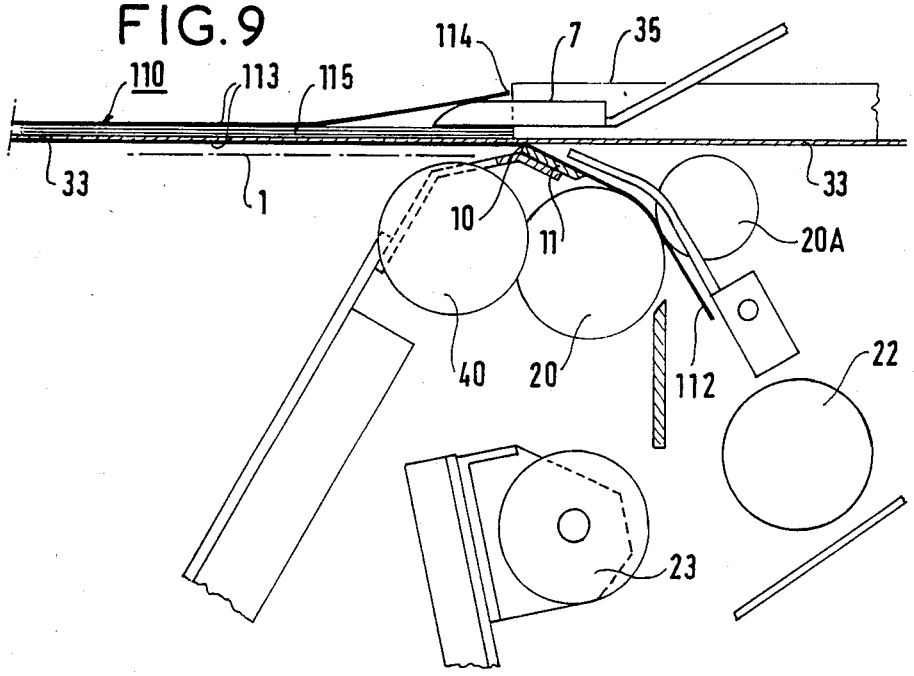

While said action 89 is being performed, the opening fingers 7 stop advancing and are held inside the envelope at the same time as the envelope takes up its final position. They advance further than the amount by which the envelope advances to take up its final position, in order to keep it open. The body of the envelope continues to be held open beyond action 85 in order to enable the carriage 33 which is advancing synchronously towards the insertion station to be inserted into the open envelope together with the sheet 115 carried by the carriage 33. FIG. 9 shows the positions of the same items on leaving exit 0 of decision operation 90 for which an envelope is not detected as being present waiting to be transferred. Under these conditions, the extraction backing wheel 23 remains in its retracted or rest position opposite the drive wheel 22 and the system is waiting for selected indicator I1 to appear. While it is waiting, the carriage 33 is fully engaged together with the sheet 115 it is carrying inside the envelope 110 by passing beneath the opening fingers 7 which are still engaged in the envelope body and which hold it open.

The carriage and the opening fingers are subsequently withdrawn from the filled envelope which is then ready to be evacuated by performing action 97 after indicator I1 has appeared as detected in operation 93.

Under steady state conditions, it may be observed relative to FIG. 9, that an envelope is normally detected as being present during operation 90 and that the backing wheel is then caused to take up its extraction position so that the envelope waiting to be transferred is ready to be transferred.

The advantages of the device for controlling the advance and the positioning of envelopes include the following in particular:

the mode of command is independent of the formats of the envelopes used;

empty envelopes are advanced and positioned and filled envelopes are advanced synchronously with the mechanical commands for the opening fingers and for the insertion carriage, with empty and filled envelopes advancing during the same stage of the control subsequence;

envelopes are advanced during the first stage at variable speed by the stepper motor, thereby enabling very high insertion rates to be achieved;

this variable speed is governed by the steps of the motor as detected during envelope advance and counted from a defined point along the envelope advance path; and the accuracy with which envelopes are put into the final position is to within $\pm 1$ mm of the desired theoretical final position and is obtained during the second stage during a sequence which is performed at a slow speed.

The present invention has been described with reference to a particular embodiment shown. Naturally, numerous detailed modifications could be made thereto and/or various means could be replaced by other, equivalent means, and it could be adapted to another embodiment of the machine without going beyond the scope of the invention. It is also clear that the numerical values given above by way of example should not under any circumstances be considered as putting a limitation on the present invention.

I claim:

1. A control device for controlling the advance and the positioning of envelopes in an insertion machine, the device comprising transfer means for transferring empty envelopes along a transfer path coupled to the inlet of an insertion station, and ejection means for ejecting envelopes filled at the insertion station, said transfer means and said ejection means being operated during an ejection and feed sequence, which sequence forms a part of a set of control sequences for the machine with the sequences being defined relative to one another for each insertion cycle, the device further including:

a stepper motor coupled in common to said transfer means and to said ejection means in order to control them simultaneously;

a clock circuit generating clock signals for each cycle and in synchronism with the progress of all of said sequences;

an envelope presence detector at an intermediate point along said path; and a circuit for controlling and governing the speed of said stepper motor, said circuit being coupled to said clock circuit and to said envelope presence detector in order to receive output signals therefrom, and being equipped firstly with first detector means for detecting a first indicator of said ejection and feed sequence on a first defined clock signal in order to control motor drive and trigger a first or "advance" drive stage on the appearance of said first indicator, and secondly with first governor means for governing said advance stage by detecting motor steps, said first governor means being triggered by the output signal from said envelope presence detector indicating that the envelope has finished going past said intermediate point in order to detect a first determined number of motor steps defined relative to the distance between said intermediate point and the inlet of the insertion station and to cause the motor to stop when said first number of detected motor steps is reached.

2. A control device according to claim 1, wherein said stepper motor is a variable speed motor.

3. A control device according to claim 2, wherein said first number of motor steps represents the distance an envelope advances from the end of going past said intermediate point until it reaches a quasi-final position defined relative to said inlet to the insertion station, said inlet to the insertion station defining the final position of the envelope.

4. A control device according to claim 3, wherein said circuit for controlling and governing the speed of said motor is further equipped, firstly with second detector means for detecting a second indicator of said ejection and feed sequence on a second defined clock signal in order to cause said motor to be driven and to trigger a second "positioning" drive stage on the appearance of said second indicator, and secondly second means for governing said positioning stage by detecting motor steps and triggered by said second indicator in order to detect a second number of motor steps representative of an advance distance between said quasi-final position and said final position.

5. A control device according to claim 4, wherein said advance stage is defined with a given motor step rate acceleration from a starting frequency up to a maximum frequency at which the speed is maintained, and wherein said first means for governing said advance stage also serve to detect a third number of motor steps which is less than said first number, relative to which it is defined, in order to control deceleration opposite to the acceleration on said third number of steps being detected.

6. A control device according to claim 5, wherein the difference between said third and first numbers of steps is chosen to be greater than the number of steps required for ensuring that the speed of the motor comes directly to its initial low frequency on said first number of steps being detected.

7. A control device according to claim 5, wherein said positioning stage is defined at a constant speed for which the step frequency of the motor is maintained at a low frequency substantially equal to its starting frequency.

8. A control device according to claim 7, wherein said circuit for controlling and governing the speed of said motor is further equipped with third means for governing said advance stage, said third means being identical to said first means, and wherein the control device further includes a detector for detecting the presence of an envelope waiting to be transferred at the inlet of said transfer circuit, said detector being coupled to said circuit for controlling and governing the speed of said stepper motor in order to select one or other of said first and third governor means depending on whether or not an envelope is detected as being present waiting for transfer, and consequently for executing said advance stage for the filled envelope to be ejected simultaneously with said advance stage for the detected envelope waiting to be transferred, or solely for the filled envelope to be ejected.

9. A control device according to claim 8, wherein said detector for detecting the presence of an envelope at said intermediate point and said detector for detecting the presence of an envelope waiting to be transferred are constituted by a single common detector.

10. A control device according to claim 9, wherein said common detector for detecting the presence of an envelope is mounted at a variable distance from the inlet of said transfer path in order to adapt to envelopes of different formats, referred to as small envelopes and large envelopes.

11. A control device according to claim 10, wherein said common detector for detecting the presence of an envelope is fixed, and the inlet to the transfar path is adjustable relative to said fixed common detector.

12. A control device according to claim 11, for an insertion machine comprising a carriage for transferring and inserting sheets, said carriage being driven in translation between a rest position in which it is at a distance from the insertion station and an insertion position in which it is engaged with a sheet in an envelope present at the insertion station, opening means referred to as opening fingers for opening the body of the envelope present in the insertion station and controlled to move between a retracted or rest position in front of the inlet to the insertion station and a position in which they open the body of the envelope; and a drive shaft having mechanical controls for said carriage and for said opening fingers engaged therewith, the control device being wherein said clock circuit is constituted by a coding disk for encoding successive angular positions of said shaft, said disk being mounted on said shaft and operating in conjunction with a sensor coupled to said disk.

13. A control device according to claim 12, wherein said first and second indicators are selected to represent two positions of the carriage at a distance from the inlet to the insertion station, with said advance and positioning stages being performed at said two distant positions prior to the arrival of the carriage at the inlet to the insertion station, and said second indicator is additionally chosen to represent the advance control applied to said opening fingers to advance them from their retracted, rest position towards their position in which they open the body of the envelope.

14. A control device according to claim 13, wherein said first indicator and said second indicator are parameters which vary with envelope format.

15. A control device according to claim 14, wherein said circuit for controlling and governing the speed of said motor is a programmed circuit.

16. A control device according to claim 15, in which the inlet to the transfer path is constituted by a substantially horizontal chute in which envelopes to be transferred to the insertion station are received separate from one another, with the edges where their flaps are folded to their envelope bodies resting in the bottom of said chute, and in which said transfer means comprise, firstly a first, "outlet" wheel, and secondly a second, upstream "envelope extraction" wheel coupled to said outlet wheel and associated with a controlled retractable extraction backing wheel, with which it is positioned at a distance from the bottom of the bottom of the chute, said distance being less than the height of the envelopes, the control device being wherein said circuit for controlling and governing the speed of the motor is additionally fitted firstly with means for controlling said extraction backing wheel to press against said wheel, said means being triggered during said positioning phase when the presence of an envelope waiting to be transferred at the inlet of the transfer path is detected, and secondly associated timing means controlling said first speed governing means depending on whether or not the timing period has elapsed.

17. A control device according to claim 15, wherein said circuit for controlling and governing the speed of said motor is coupled to said stepper motor via a power control circuit for feeding the motor with pulses of current.

18. A control device according to claim 15, wherein said circuit for controlling and governing the speed of said motor is further equipped with initialization means for detecting the format of an envelope by counting the number of motor steps between the beginning of envelope transfer and the end of its passage through said intermediate point, said count taking place during said ejection and feed sequence belonging to an initialization cycle of the machine, and for selecting an appropriate pair of indicators depending on the detected envelope format.

19. A control device according to claim 16, wherein the inlet to the insertion station is defined to be vertically above substantially the midpoint between the axes of the outlet wheel belonging to the transfer means and an ejection wheel belonging to the ejection means.

20. A control device according to claim 19, wherein said inlet to said insertion station is constituted by an edge projecting outside said outlet wheel and said ejection wheel.

21. A control device according to claim 12, wherein the coding disk has, substantially around its periphery, a non-looped series of first openings at a regular pitch and defining a gap where a few of said first openings are missing, and a second opening which is radially offset relative to said series of said first openings and which is at least partially level with said gap having no first openings, and wherein said sensor is constituted by a pair of sensors with one of the sensors being for detecting the passage of said first openings and with the other sensor being for detecting said second opening for controlling the generation of clock signals at a rate specified by the detection of said first openings passing, starting from a reference value placed on detecting the passage of said second opening.

* * * * *